US005103545A

United States Patent [19]

Riehl

[11] Patent Number: 5,103,545

[45] Date of Patent: Apr. 14, 1992

[54] BURNER CONSTRUCTION AND METHOD OF AND APPARATUS FOR MAKING THE SAME

[75] Inventor: Fred Riehl, Greensburg, Pa.

[73] Assignee: RobertShaw Controls Company, Richmond, Va.

[21] Appl. No.: 541,150

[22] Filed: Jun. 20, 1990

Related U.S. Application Data

[62] Division of Ser. No. 450,581, Dec. 13, 1989, Pat. No. 4,951,880.

[51] Int. Cl.[5] ..... B21D 28/10

[52] U.S. Cl. ..... 29/283.5

[58] Field of Search ..... 29/283.5, 157 C; 72/325, 326; 239/566, 568; 431/354

[56] References Cited

U.S. PATENT DOCUMENTS 3,386,431 6/1968 Branson ..... 29/157 C
4,055,132 10/1977 Stohrer et al. ..... 72/326
4,364,406 12/1982 Bohlin ..... 72/325
4,418,456 12/1983 Riehl ..... 29/157 C
4,930,384 6/1990 Nakatsuji ..... 72/325

*Primary Examiner*—Robert C. Watson
*Attorney, Agent, or Firm*—Candor, Candor & Tassone

[57] ABSTRACT

A burner construction and a method of and an apparatus for making the same are provided, the burner construction comprising a wall structure having an exterior surface and having an interior surface that defines a chamber in the burner construction for receiving fuel from a fuel source, the wall structure having a plurality of elongated ports formed through the surfaces thereof and thereby communicating with the chamber, the ports being disposed in spaced apart substantially parallel relation with each port being defined between a pair of adjacent edges of the wall structure that are disposed in spaced apart substantially parallel relation whereby fuel is adapted to flow from the chamber out through the ports between the adjacent edges thereof to burn adjacent the exterior surface of the wall structure, the edges each being extruded into the chamber beyond the interior surface of the wall structure.

2 Claims, 4 Drawing Sheets

BURNER CONSTRUCTION AND METHOD OF AND APPARATUS FOR MAKING THE SAME

CROSS REFERENCE TO RELATED APPLICATION

This application is a divisional patent application of its copending parent patent application. Ser. No. 450,581, filed Dec. 24, 1989, now U.S. Pat. No. 4,951,880.

BACKGROUND OF THE INVENTION

1. Field of the Invention

This invention relates to a new burner construction as well as to a new method of making such a burner construction and a new apparatus for making such a burner construction.

2. Prior Art Statement

It is known to provide a burner construction comprising wall means having exterior surface means and having interior surface means that define chamber means in the burner construction for receiving fuel from a fuel source, the wall means having a plurality of elongated ports formed through the surface means thereof and thereby communicating with the chamber means, the ports being disposed in spaced apart substantially parallel relation with each port being defined between a pair of adjacent edge means of the wall means that are disposed in spaced apart substantially parallel relation whereby fuel is adapted to flow from the chamber means out through the ports between the adjacent edge means thereof to burn adjacent the exterior surface means of the wall means. For example, see the U.S. patent to Riehl, U.S. Pat. No. 4,418,456.

Also see the U.S. patent to Branson, U.S. Pat. No. 3,386,431, wherein ports in a burner construction are formed by carving material from the wall means of the burner construction and bending that tab means into the interior of the wall means beyond the interior surface means thereof to define a port through the wall means.

SUMMARY OF THE INVENTION

It is one of the features of this invention to provide a new burner construction that can be formed from a sheet metal tube or a metallic extruded tube and have porting therein that functions in a manner similar to a cast slotted port burner design.

In particular, it is well known that in a cast burner design, the slotted ports each has the edge means thereof defined by portions of the cast burner that are relatively long between the exterior surface means of the burner and the interior surface means thereof so that the velocity of the fuel flowing through such port engages the relatively long edge means of the port and creates a turbulence at the base of the fuel emission to mix with the secondary air for good combustion of the outer mantle of the flame area.

It was found according to the teachings of this invention that when a burner tube is formed from stamped sheet metal or from a metallic extruded tube and each port thereof is defined by bending material of the sheet into the interior chamber thereof to define the port, the edge means of the port is not long enough to produce the desired turbulence of the fuel as in the cast slotted port burner design.

However, it was also found according to the teachings of this invention that if the tab of material that is being bent into the chamber means from the stamped sheet of metal or extruded tube is extruded in a manner to elongate the same, then a sufficient length to the edge means of the port beyond the interior surface means can be provided for the desired improved combustion thereof.

For example, one embodiment of this invention comprises a burner construction comprising wall means having exterior surface means and having interior surface means that define chamber means in the burner construction for receiving fuel from a fuel source, the wall means having a plurality of elongated ports formed through the surface means thereof and thereby communicating with the chamber means, the ports being disposed in spaced apart substantially parallel relation with each port being defined between a pair of adjacent edge means of the wall means that are disposed in spaced apart substantially parallel relation whereby fuel is adapted to flow from the chamber means out through the ports between the adjacent edge means thereof to burn adjacent the exterior surface means of the wall means, the edge means each being extruded into the chamber means beyond the interior surface means of the wall means.

Accordingly, it is an object of this invention to provide a new burner construction having one or more of the novel features of this invention as set forth above or hereinafter shown or described.

Another object of this invention is to provide a new method of making such a burner construction, the method of this invention having one or more of the novel features of this invention as set forth above or hereinafter shown or described.

Another object of this invention is to provide a new apparatus for making such a burner construction, the apparatus of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figures 1, 2, 3:
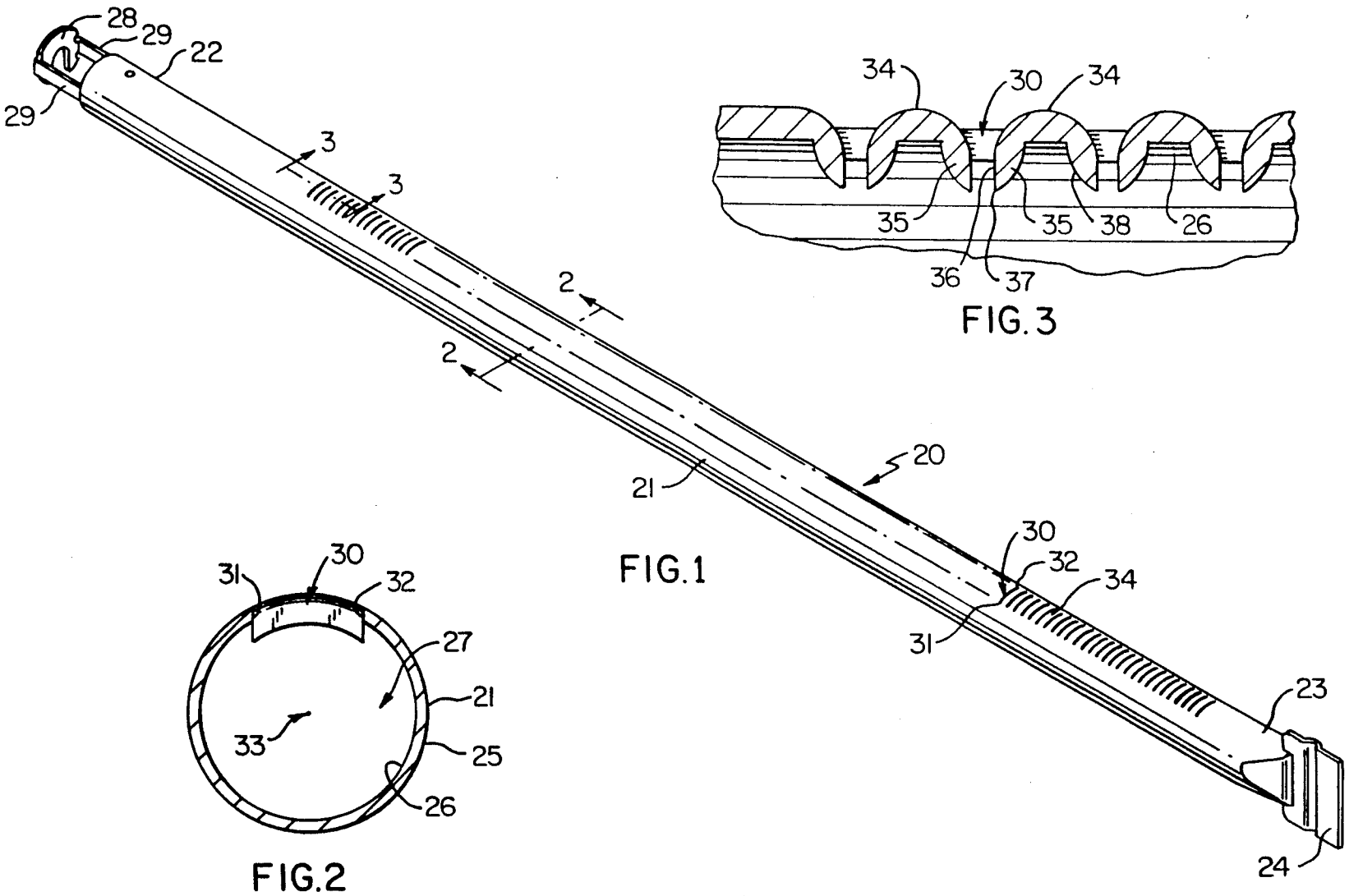
FIG. 1 is a perspective view of a new burner construction of this invention.
FIG. 2 is an enlarged cross-sectional view taken on line 2—2 of FIG. 1.
FIG. 3 is an enlarged fragmentary cross-sectional view taken on line 3—3 of FIG. 1.

While the various features of this invention are hereinafter illustrated and described as being particularly adapted to provide a burner construction for burning gaseous fuel, such as natural or synthetic gas, it is to be understood that the various features of this invention can be utilized singly or in various combinations thereof to provide a burner construction for other types of fuel as desired.

Therefore, this invention is not to be limited to only the embodiments illustrated in the drawings, because the drawings are merely utilized to illustrate one of the wide variety of uses of this invention.

Referring now to FIGS. 1-3, a new burner construction of this invention is generally indicated by the reference numeral 20 and comprises a wall means 21 formed of metallic material, such as aluminized steel and either being formed by stamping sheet metal and forming the same in the tubular form illustrated or being formed as a metallic tube by conventional extruding apparatus, and having a generally circular cross-sectional configuration as illustrated in FIG. 2 from one end 22 thereof to the other end 23 thereof, the end 23 being interconnected to a suitable mounting plate 24 in any suitable manner or being deformed into such mounting plate 24 so as to be integral and one-piece therewith, as desired.

In one working embodiment of this invention, the tubular wall means 21 is formed of aluminized steel tubing, such as RMS-302 and the same has an outer diameter of approximately 1.000 of an inch and a wall thickness of approximately 0.035 of an inch whereas the overall length of the wall means 21 from the end 22 to the end 23 thereof is approximately 23.850 inches.

The wall means 21 has an exterior surface means 25 and an interior surface means 26, the interior surface means 26 being substantially uniformly spaced from the exterior surface means 25 by the relatively uniform thickness of the wall means 21 as illustrated in FIG. 2.

The interior surface means 26 of the wall means 21 defines an internal chamber means 27 that leads from the open end 22 of the burner construction 20 to its closed end 23, the open end 22 of the burner construction 20 having an orifice adaptor 28 spaced therefrom by side parts 29, the orifice adaptor 28 and side parts 29 either being integral and one-piece with the wall means 21 or being separate therefrom and being subsequently attached thereto as desired. Such orifice support 28 is generally well known in the art. For example, see the aforementioned U.S. patent to Riehl, U.S. Pat. No. 4,418,456, whereby this patent is being incorporated into this disclosure by this reference thereto.

The burner construction 20 has a plurality of ports 30 formed through the surface means 25 and 26 of the wall means 21 so as to communicate with the chamber means 27 whereby gaseous fuel or the like is adapted to be directed into the open end 22 of the burner construction 20 and issue out of the ports 30 to burn adjacent the exterior surface means 25 thereof in a manner well known in the art. For example, see the aforementioned U.S. patent to Branson, U.S. Pat. No. 3,386,431, whereby this patent is also being incorporated into this disclosure by this reference thereto.

The ports 30 are uniquely formed through the wall means 21 in a manner hereinafter described and each is elongated, has opposed ends 31 and 32 and is substantially straight between the opposed ends 31 and 32 thereof in a manner to be disposed substantially transverse to a longitudinal axis of the burner construction 20 which is represented by the reference numeral 33 in FIG. 2. The ports 30 are disposed substantially parallel to each other in spaced apart relation by unported portions or lands 34 of the wall means 21 which in the embodiment illustrated in FIGS. 1-3 substantially uniformly spaced the ports 30 from each other throughout the length of the burner construction 20.

However, it is to be understood that the lengths of the ports 30 of this invention can be varied to suit particular fuel requirements and are not limited to being a single row of ports as the same could comprise multiple rows of selected sizes and widths using various tubular diameters and configurations as desired.

Each port 30 has opposed or spaced apart side edge means 35 that are disposed substantially parallel to each other in spaced apart relation and respectively extend into the chamber means 27 beyond the interior surface means 26 of the wall means 21 as illustrated in FIGS. 2 and 3, each edge means 35 having been carved from the material of the wall means 21 that forms the respective port 30 thereof and having been extruded or elongated in a radial direction toward the longitudinal axis 33 so as to provide a length thereof that is greater than the original amount of material of the wall means 21 that would normally be bent into the chamber means 27 if the edge means 35 merely comprised conventional tabs that are bent into a chamber means of a burner construction in a manner similar to the tab means of the aforementioned U.S. patent to Branson, U.S. Pat. No. 3,386,431.

It is this feature of extruding or elongating the edge means 35 of the port means 30 into the chamber means 27 of the burner construction 20 beyond the interior surface means 26 thereof that provides the ports 30 of this invention each with a channel depth that minimizes flashback on fast burning gases and that provides an improved flame retention in the area adjacent to the mixer tube end 22 of the burner construction 20. In addition, this formed extruded port depth enhances the port fuel velocity thereby improving the combustion of the outer mantle of the flame area by introducing turbulence at the base of the fuel emissions to mix with the secondary air.

Also, it will be seen that the method and apparatus of this invention forms the lands 34 of the wall means 21 between the ports 30 with an arcuate configuration that has the exterior surface means 25 thereof convex as illustrated in FIG. 3 to provide for improved flame propagation between the ports 30 even on low fuel input rates while maintaining port spacings that permit induction of sufficient secondary air to complete the combustion process of the fuel issuing from the ports 30.

This arcuate surface of the lands 34 each extends into the ports 30 on each side thereof and then defines a substantially straight surface 36 on the respective edge means 35 that terminates at an end 37 as illustrated in FIG. 3. In contrast, the inside surface means 26 of each land 34 remains substantially straight as illustrated in FIG. 3 between the adjacent extruded edge means 35 which also have arcuate surface means 38 that terminate at the ends 37 as illustrated in FIG. 3.

In the aforementioned one working embodiment of the burner construction 20 of this invention, the spacing between the straight surfaces 36 of the adjacent extruded edge means 35 for each port 30 is approximately 0.030 of an inch while the length of each edge means 35 beyond the interior surface means 26 to the point or end 37 thereof is approximately 0.050 of an inch with the surfaces 38 thereof each being defined by a radius of approximately 0.065 of an inch and being spaced from each other by the interior surface means 26 of its respective land 34 of approximately 0.045 of an inch while the exterior surface 25 of each land 34 is defined on a radius of approximately 0.040 of an inch with the two edge means 35 on each side of a land area 34 having the surfaces 36 thereof spaced from each other by a distance of approximately 0.138 of an inch.

Figure 11:
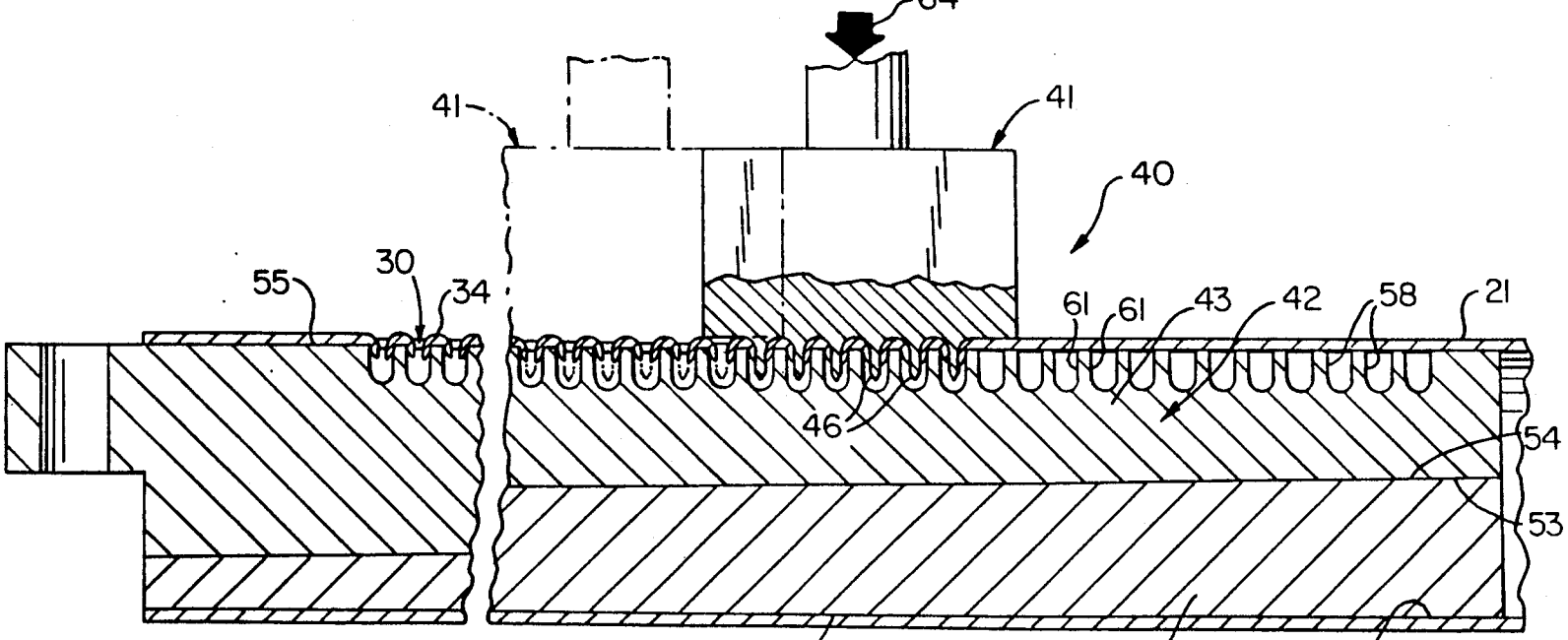
FIG. 11 is a fragmentary broken away cross-sectional view illustrating the apparatus of this invention for forming the burner construction of FIGS. 1-3.

The method and apparatus of this invention for forming the port means 30 and the extruded edge means 35 thereof previously described is generally indicated by the reference numeral 40 in FIG. 11 and comprises an external die means 41 and an internal die means 42 that comprise a first internal die part or member 43 and a second internal die part or member 44 whereby the die parts 43 and 44 are assembled together and disposed within a non-ported tubular wall means 21 as illustrated in FIG. 11 and cooperate with the external die means 41 to form the ports 30 and extruded edge means 35 as the die means 41 is lowered and raised and then indexed from left to right in FIG. 11 to carve the edge means 35 from the wall means 21 to form the ports 30 and inwardly extrude the edge means 35 as will be apparent hereinafter.

While the die parts 41, 42 and 43 can be formed on any suitable material, such as metallic material, the one working embodiment of the die parts 41, 43 and 44 of this invention that formed the one working embodiment of the burner construction 20 previously set forth comprise carbon tool steel known as Rockwell C 55-60.

Figure 5:
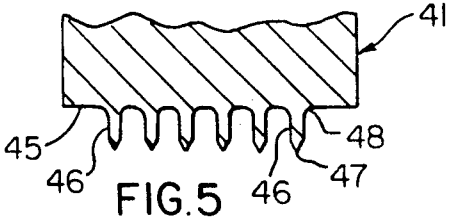
FIG. 5 is a fragmentary cross-sectional view taken on line 5—5 of FIG. 4.
Figure 4:
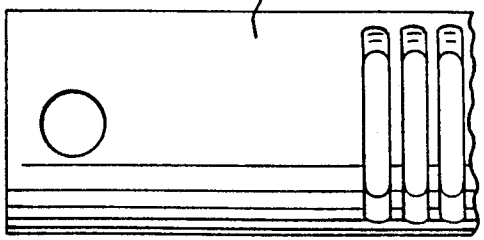
FIG. 4 is an end view of one die member of the apparatus of this invention for forming the burner construction of FIGS. 1—3.
Figure 4:
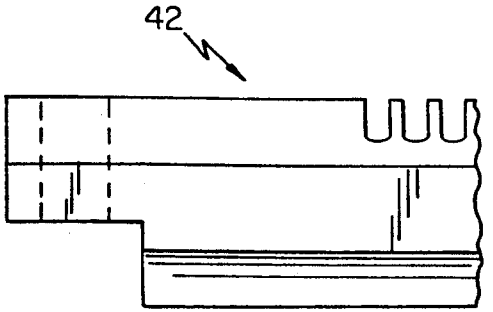
Figure 4:
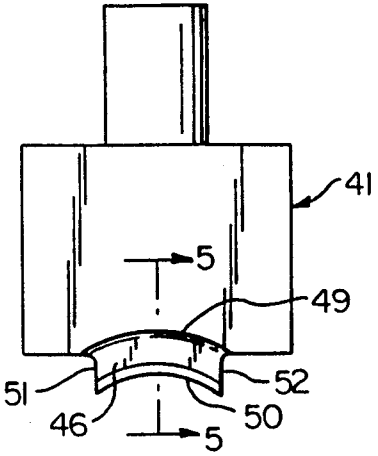
Figure 9:
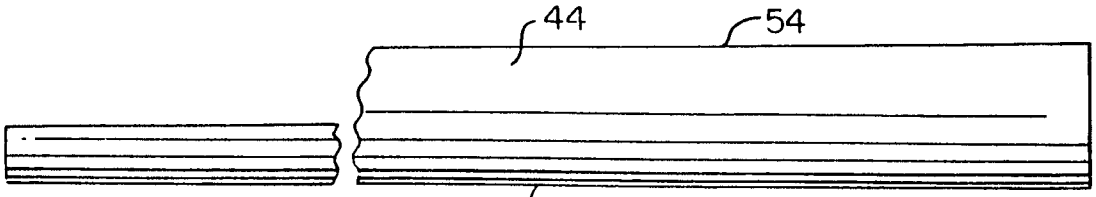
FIG. 9 is a side view of another part of the die member of FIGS. 6-8.
Figure 10:
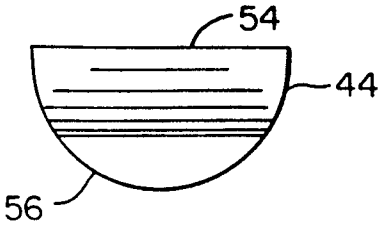
FIG. 10 is an end view of the die part of FIG. 9.

As illustrated in FIGS. 4 and 5, the external die member 41 has a lower surface 45 provided with a plurality of spaced apart teeth 46 extending therefrom with the teeth 46 in the previously described one working embodiment thereof extending approximately 0.150 of an inch below the surface 45, being spaced apart approximately 0.138 of an inch, being approximately 0.028 of an inch thick between opposed substantially flat sides 46' thereof and having pointed apexes 47 defined by angled surfaces of approximately 30°. The particular die member 41 has six such teeth 46 and the teeth 46 join to the surface 45 with arcuate surfaces 48 that are each defined by a radius of approximately 0.040 of an inch so as to form the arcuate land areas 34 on the exterior surface means 25 of the wall means 21 as previously set forth when the die means 41 has been moved inwardly to its full position as illustrated in FIG. 11.

The surface 45 of the die member 41 that has the teeth 46 extending therefrom has an arcuate inner end 49 defined on a radius of approximately 0.568 of an inch as illustrated in FIG. 4 while an arcuate surface 50 that defines the tips 47 of the teeth 46 is defined by a radius of approximately 0.418 of an inch and the length between opposed ends 51 and 52 of each tooth 46 is approximately 0.479 of an inch.

The inner die parts or members 43 and 44 respectively have cooperating adjacent surfaces 53 and 54 which permit the same to be disposed together and thereby be inserted into the non-ported tubular wall means 21 in the manner illustrated in FIG. 11 and after the port means 30 and extruded edge means 35 of the wall means 21 have been formed through the cooperating die means 41 and 42 as hereinafter set forth, the part 44 can be first removed from the formed tubular wall means 21 out through the right as illustrated in FIG. 11 and then the die part 43 can be dropped downwardly and then also removed from the wall means 21 in a manner well known in the art of forming projections into a tubular member with an internal die member or mandrel that is to be subsequently removed therefrom.

Thus, it can be seen that the die members 43 and 44 respectively have outer surface means 55 and 56 that cooperate with the interior surface means 26 of the wall means 21 when disposed within the wall means 21 in the manner illustrated in FIG. 11 to provide a substantially solid internal mandrel means in the wall means 21 so as to dispose the surface means 55 of the die part 43 closely against the internal surface means 26 of the wall means 21 as illustrated in FIG. 11.

The surface 55 of the die part 43 is interrupted by a plurality of recesses 57 which define a plurality of teeth 58 that are disposed substantially parallel to each other in spaced apart relation and respectively have opposed ends 59 and 60 as illustrated.

Figure 8:
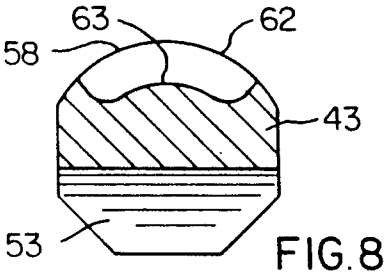
FIG. 8 is a cross-sectional view taken on line 8—8 of FIG. 7.
Figure 6:
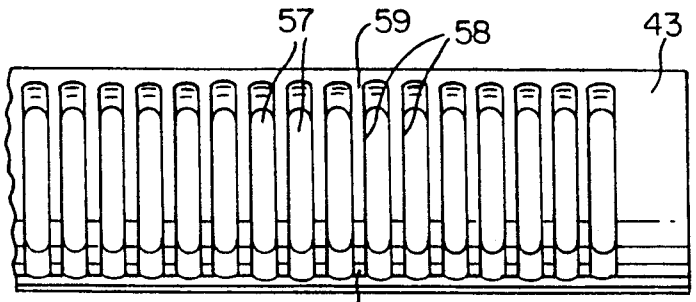
FIG. 6 is a top view of another die member of the apparatus of this invention for forming the burner construction of FIGS. 1-3.
Figure 7:
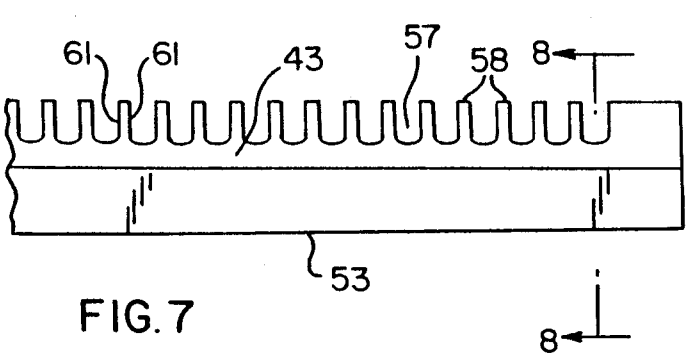
FIG. 7 is a side view of the die member of FIG. 6.

In the one working embodiment of the apparatus 40 of this invention that forms the one working embodiment of the burner construction 20 previously set forth, the teeth 58 have adjacent flat sides 61 thereof each spaced from the flat side 61 of an adjacent tooth 58 by a distance of approximately 0.093 of an inch, each tooth 58 being substantially flat on a free end 62 thereof and extending from an interior surface 63 of the mandrel member 43 a distance of approximately 0.150 of an inch with the center of each surface 63 being spaced from the adjacent center of an adjacent space 57 by a distance of approximately 0.138 of an inch. As illustrated in FIG. 8, the exterior surface 62 of each tooth 58 is defined by a radius of approximately 0.453 of an inch while the interior surface 63 is defined on a radius of approximately 0.303 of an inch.

Thus, when a non-ported tubular wall means 21 is disposed in the position illustrated in FIG. 11 and the die parts 43 and 44 are assembled therein, the die part 41 can be forced toward the wall means 21 by a suitable-ram means (not shown but represented by the arrow 64 in FIG. 11) to cause the teeth 46 thereof to punch or carve through the wall means 21 and cooperate with the teeth 58 and recesses 57 of the inner die member 43 to form the ports 30 and extrude or elongate the edge means 35 of the wall means 21 between the cooperating surfaces 46' and 61 of the teeth 46 and 58 in the draw and iron manner illustrated in FIG. 11 and thereby form the ports 30 and extruded edge means 35 in the configurations illustrated in FIG. 3 and as previously set forth, the die means 41 forming six such ports 30 in the embodiment illustrated in FIG. 11 and then when backed out and indexed to the right can form an additional six ports 30 in the manner previously set forth so that as the die member 41 is indexed from left to right, the desired number of ports 30 through the wall means 21 can be formed in a conventional die manner to uniquely form the ports 30 and extruded edge means 35 in the manner previously set forth.

After the die members 41 and 42 have been utilized to form the ports 30 in the manner previously set forth, the die members 43 and 44 can be serially removed from the now ported tube 20 as previously set forth and then the end means 23 can be formed to form the mounting plate 24 and the orifice structure 28 can be provided in the manner previously set forth to complete the burner construction 20 of this invention that is adapted to be utilized in the manner set forth in the aforementioned U.S. patent to Riehl, U.S. Pat. No. 4,418,456, and/or in the manner set forth in the aforementioned patent to Branson, U.S. Pat. No. 3,386,431 whereby the details of the operation of the burner construction 20 need not be further set forth.

While various dimensions have been previously set forth for one working embodiment of the burner construction 20 and apparatus and method 40 of this invention, it is to be understood that such dimensions are not to be a limitation on this invention as other dimensions can be utilized, as desired.

Another burner construction of this invention is generally indicated by the reference numeral 20A in FIGS. 12–15 and parts thereof similar to the burner construction 20 previously described are indicated by like reference numerals followed by the reference letter "A".

Figures 12, 13, 14, 15:
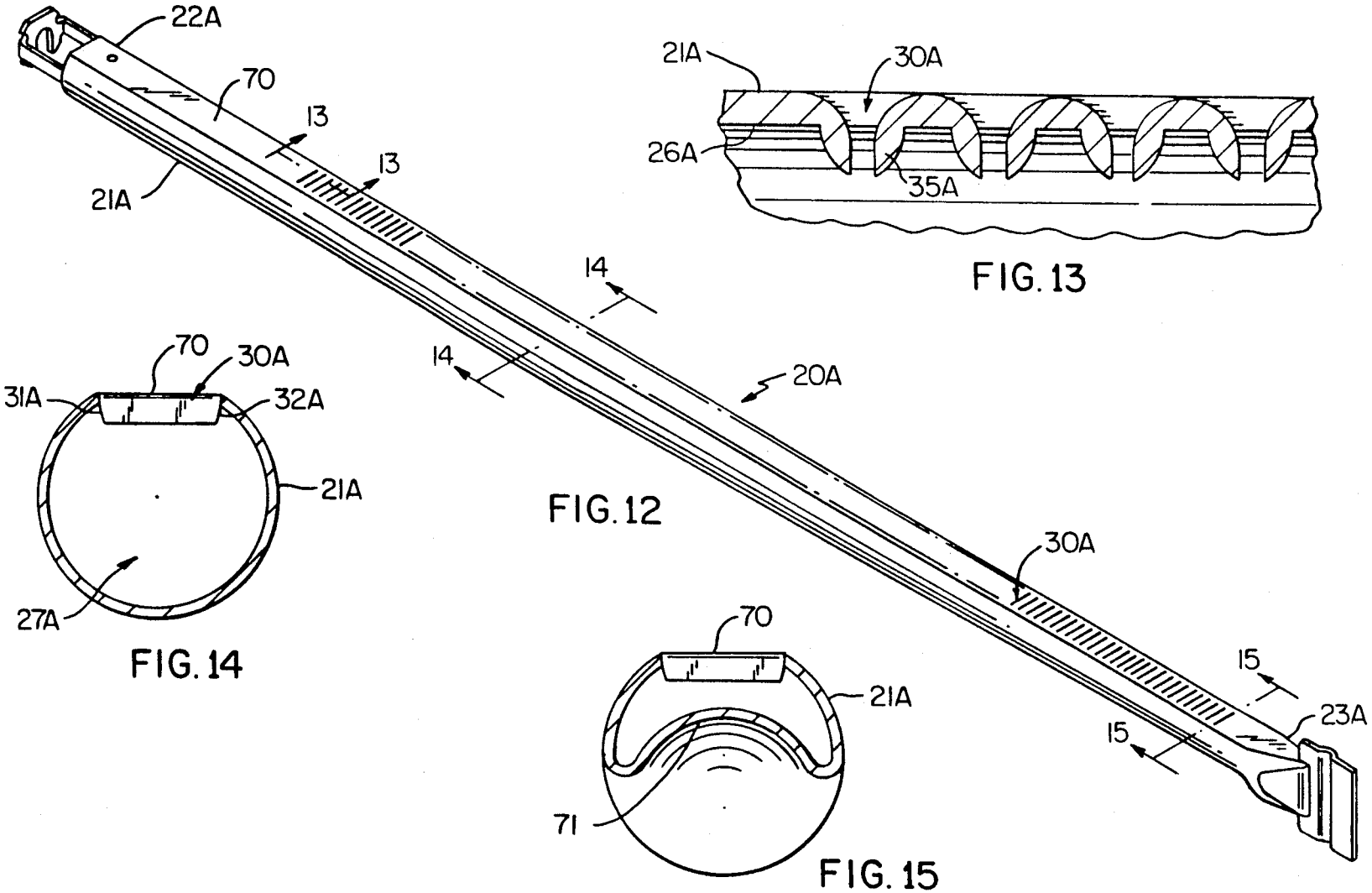
FIG. 12 is a view similar to FIG. 1 and illustrates another burner construction of this invention.
FIG. 13 is an enlarged fragmentary cross-sectional view taken on line 13—13 of FIG. 12.
FIG. 14 is an enlarged cross-sectional view taken on line 14—14 of FIG. 12.
FIG. 15 is an enlarged cross-sectional view taken on line 15—15 of FIG. 12.

As illustrated in FIGS. 12–15, the burner construction 20A is substantially the same as the burner construction 20 previously described except that the wall means 21A has a flat section or portion 70 through which the ports 30A are formed so that the resulting edge means 35A thereof are substantially straight and nonarcuate between the opposed ends 31A and 32A thereof as illustrated in FIG. 14.

In addition, the chamber means 27A formed by the wall means 21A is reduced in volume from the open end 22A thereof to the closed end 23A thereof by having the wall means 21A deformed inwardly in the manner illustrated by the reference numeral 71 in FIG. 15.

However, it can be seen that the edge means 35A of the ports 30A are extruded or elongated radially inwardly beyond the interior surface means 26A in the manner previously described for the burner construction 20 to provide the unique feature thereof that has also been previously described.

Therefore, it can be seen that this invention not only provides a new burner construction, but also this invention provides a new method of making such a burner construction and a new apparatus for forming such a burner construction.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In an apparatus for making a burner construction comprising wall means having exterior surface means and having interior surface means that define chamber means in said burner construction for receiving fuel from a fuel source, said wall means having a plurality of elongated ports formed through said surface means thereof and thereby communicating with said chamber means, said ports being disposed in spaced apart substantially parallel relation with each port being defined between a pair of adjacent edge means of said wall means that are disposed in spaced apart substantially parallel relation whereby fuel is adapted to flow from said chamber means out through said ports between said adjacent edge means thereof to burn adjacent said exterior surface means of said wall means, said apparatus having die means for punching through said exterior surface means of said wall means to form each said port, the improvement wherein said die means comprises a pair of cooperating dies for drawing and ironing each said edge means therebetween to elongate that said edge means into said chamber means beyond said interior surface means of said wall means.

2. An apparatus as set forth in claim 1 wherein one of said dies has a tooth provided with opposed sides and the other of said dies has a recess therein that defines spaced apart surfaces and between which said tooth will move to respectively draw and iron adjacent edge means between said sides and said surfaces of said dies as said tooth of said one of said dies punches through said wall means and moves into said recess of said other of said dies when forming one of said ports.

* * * * *